US010625963B2

(12) United States Patent
Ando

(10) Patent No.: US 10,625,963 B2
(45) Date of Patent: Apr. 21, 2020

(54) FEEDING DEVICE AND IMAGE FORMING APPARATUS

(71) Applicant: KYOCERA Document Solutions Inc., Osaka (JP)

(72) Inventor: Satoshi Ando, Osaka (JP)

(73) Assignee: KYOCERA Document Solutions, Inc., Osaka (JP)

( * ) Notice: Subject to any disclaimer, the term of this patent is extended or adjusted under 35 U.S.C. 154(b) by 0 days.

(21) Appl. No.: 16/218,111

(22) Filed: Dec. 12, 2018

(65) Prior Publication Data

US 2019/0185279 A1 Jun. 20, 2019

(30) Foreign Application Priority Data

Dec. 15, 2017 (JP) ..... 2017-240655

(51) Int. Cl.

| | |
|---|---|
| ***B65H 1/26*** | (2006.01) |
| ***B65H 1/04*** | (2006.01) |
| ***B65H 5/06*** | (2006.01) |
| ***B65H 3/44*** | (2006.01) |
| ***B65H 7/02*** | (2006.01) |

(52) U.S. Cl.

CPC ..... *B65H 1/266* (2013.01); *B65H 1/04* (2013.01); *B65H 3/44* (2013.01); *B65H 5/062* (2013.01); *B65H 7/02* (2013.01); *B65H 2402/5155* (2013.01); *B65H 2405/11* (2013.01); *B65H 2405/121* (2013.01); *B65H 2405/313* (2013.01); *B65H 2405/332* (2013.01); *B65H 2801/06* (2013.01)

(58) Field of Classification Search

CPC . B65H 1/00; B65H 1/04; B65H 1/266; B65H 3/44; B65H 7/00; B65H 7/02; B65H 7/14; B65H 7/18; B65H 7/20; B65H 2405/11; B65H 2405/12; B65H 2405/121; B65H 2405/313; B65H 2405/332; B65H 2402/5155

See application file for complete search history.

(56) References Cited

U.S. PATENT DOCUMENTS 8,833,757 B1 * 9/2014 Piening ..... B65H 3/0684 271/121
10,146,166 B2 * 12/2018 Takai ..... G03G 21/1647
(Continued)

FOREIGN PATENT DOCUMENTS

JP H09-110194 A 4/1997

*Primary Examiner* — Prasad V Gokhale
(74) *Attorney, Agent, or Firm* — Studebaker & Brackett PC

(57) ABSTRACT

A feeding device includes a first feeding unit, a second feeding unit, and a fixing structure. The first feeding unit feeds a first recording medium. The second feeding unit is located below the first feeding unit and feeds a second recording medium. The fixing structure takes a first posture or a second posture differing from the first posture. The fixing structure fixes the second feeding unit to the first feeding unit when the fixing structure is in the first posture. The fixing structure fixes the second feeding unit to the first feeding unit by fixing a third frame member of the second feeding unit to a second frame member of the first feeding unit. When the fixing structure is in the second posture, the fixing structure releases linkage between the second feeding unit and the first feeding unit.

6 Claims, 12 Drawing Sheets

(56) References Cited

U.S. PATENT DOCUMENTS

| | | | | |
|---|---|---|---|---|
| 2004/0251597 | A1* | 12/2004 | Ito | B65H 1/04 271/145 |
| 2009/0302521 | A1* | 12/2009 | Kondo | B65H 1/04 271/9.01 |
| 2018/0111784 | A1* | 4/2018 | Matsumoto | B65H 1/04 |

* cited by examiner

FEEDING DEVICE AND IMAGE FORMING APPARATUS

INCORPORATION BY REFERENCE

The present application claims priority under 35 U.S.C. § 119 to Japanese Patent Application No. 2017-240655, filed on Dec. 15, 2017. The contents of this application are incorporated herein by reference in their entirety.

BACKGROUND

The present disclosure relates to a feeding device and an image forming apparatus.

An image forming apparatus includes an image forming apparatus main body and a feeding unit. The image forming apparatus main body includes a latch target member. The feeding unit includes a paper feed cassette and a latching member. The latching member is configured to operate in association with a setting operation of the paper feed cassette. The setting operation refers to an operation for setting the paper feed cassette to a position where paper can be fed from the paper feed cassette. That is, the latching member engages with the latch target member of the image forming apparatus main body when the setting operation of the paper feed cassette is performed. Another feeding unit is provided in a lower part of the image forming apparatus main body. That is, the feeding unit (second feeding unit) can be fixed to the image forming apparatus main body by fixing the feeding unit (second feeding unit) to the other feeding unit (first feeding unit) included in the image forming apparatus main body.

SUMMARY

A feeding device according to an aspect of the present disclosure includes a first feeding unit, a second feeding unit, and a fixing structure. The first feeding unit feeds a first recording medium. The second feeding unit is located below the first feeding unit and feeds a second recording medium differing from the first recording medium. The fixing structure takes a first posture or a second posture differing from the first posture. The fixing structure fixes the second feeding unit to the first feeding unit when the fixing structure is in the first posture. The fixing structure fixes the second feeding unit to the first feeding unit by fixing a frame member of the second feeding unit to a frame member of the first feeding unit. When the fixing structure is in the second posture, the fixing structure releases linkage between the second feeding unit and the first feeding unit.

An image forming apparatus according to another aspect of the present disclosure includes an image forming device, a first feeding unit, a second feeding unit, and a fixing structure. The image forming device forms an image on a recording medium. The recording medium is either a first recording medium or a second recording medium differing from the first recording medium. The first feeding unit feeds the first recording medium to the image forming device. The second feeding unit is located below the first feeding unit and feeds the second recording medium to the image forming device. The fixing structure takes a first posture or a second posture differing from the first posture. The fixing structure fixes the second feeding unit to the first feeding unit when the fixing structure is in the first posture. The fixing structure fixes the second feeding unit to the first feeding unit by fixing a frame member of the second feeding unit to a frame member of the first feeding unit. When the fixing structure is in the second posture, the fixing structure releases linkage between the second feeding unit and the first feeding unit.

DETAILED DESCRIPTION

Figure 1:
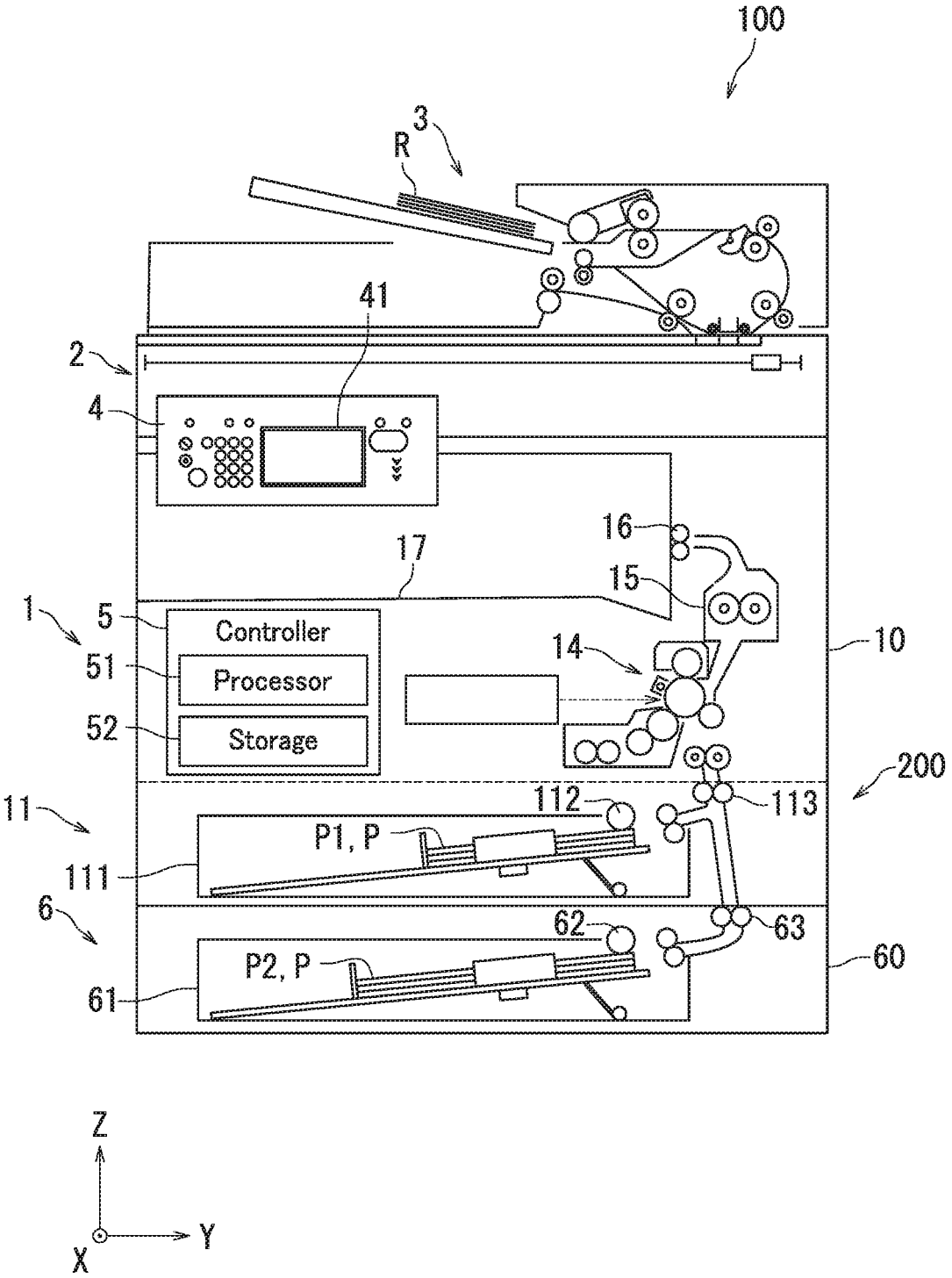
FIG. 1 is a diagram illustrating a configuration of an image forming apparatus according to an embodiment of the present disclosure.

The following describes an embodiment of the present disclosure with reference to the drawings (FIGS. 1 to 12). Note that elements that are the same or equivalent are labelled using the same reference signs in the drawings, and description of those elements will not be repeated.

Figure 2:
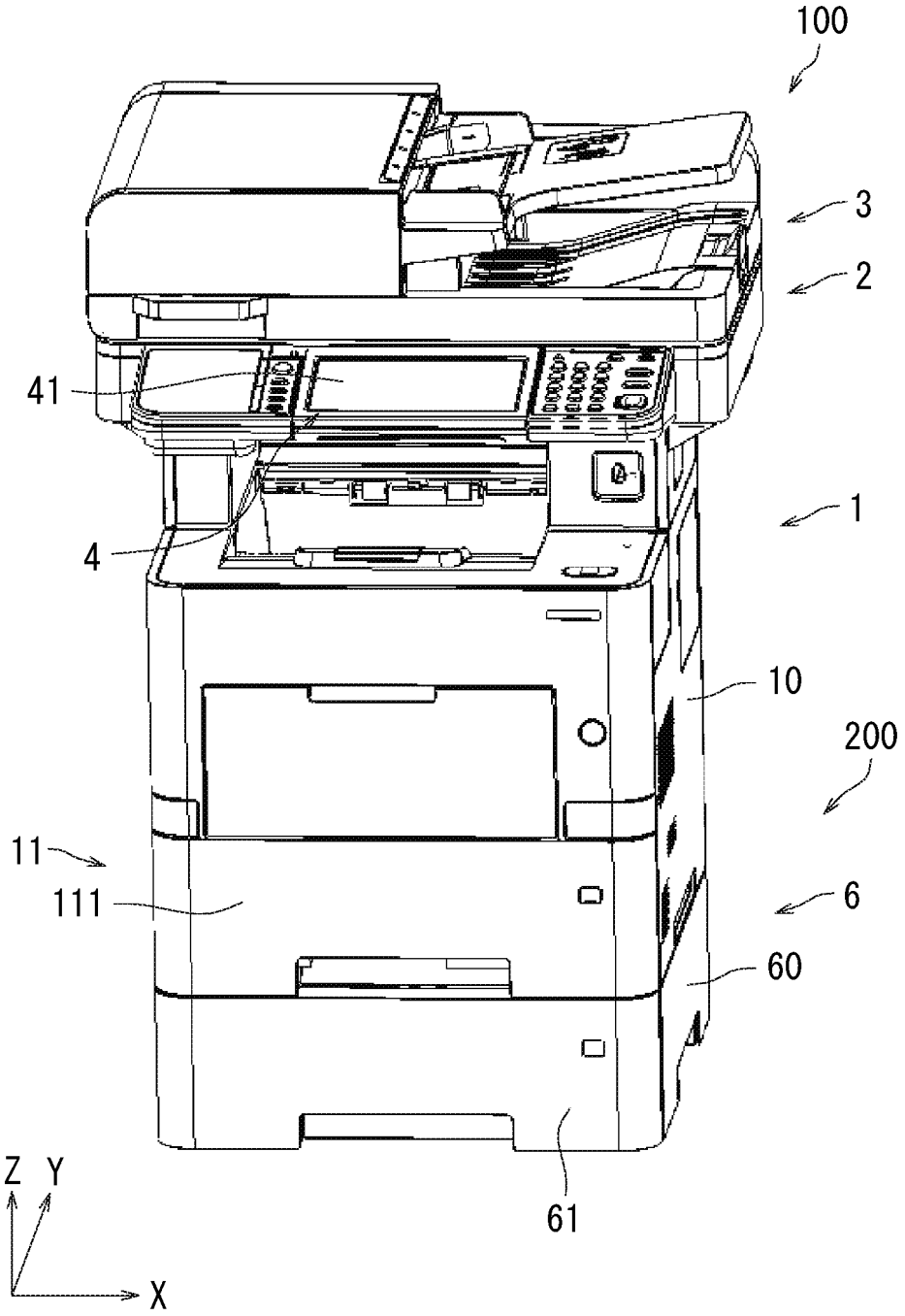
FIG. 2 is a perspective view illustrating the configuration of the image forming apparatus.

The following first describes an image forming apparatus 100 according to the embodiment of the present disclosure with reference to FIGS. 1 and 2. FIG. 1 is a diagram illustrating a configuration of the image forming apparatus 100. FIG. 2 is a perspective view illustrating the configuration of the image forming apparatus 100. As illustrated in FIG. 1, the image forming apparatus 100 is a multifunction peripheral. The image forming apparatus 100 includes an image forming unit 1, an image reading unit 2, a document conveyance unit 3, an operation display section 4, and a controller 5.

The image forming unit 1 forms an image on a sheet P. The image reading unit 2 reads an image formed on a document R to generate read image data. The document conveyance unit 3 conveys the document R to the image reading unit 2. The operation display section 4 receives an operation performed by a user. The controller 5 controls operation of the image forming apparatus 100.

FIG. 1 illustrates X, Y, and Z axes orthogonally crossing each other. The X and Y axes are parallel to a horizontal plane. The Z axis is parallel to a vertical direction. In the following description, a positive side of the Y axis (i.e., a side indicated by an arrow of the Y axis) may be referred to as a rear side and a negative side of the Y axis (i.e., a side opposite to the side indicated by the arrow of the Y axis) may be referred to as a front side.

The image forming unit 1 includes a casing 10, a feeding device 200, an image forming device 14, a fixing device 15, an ejection roller pair 16, and an exit tray 17. The feeding device 200 includes a first feeding unit 11 and a second feeding unit 6. The casing 10 accommodates the first feeding unit 11, the image forming device 14, the fixing device 15, and the ejection roller pair 16.

The first feeding unit 11 includes a first feeding cassette 111, a pickup roller 112, and a conveyance roller pair 113. The second feeding unit 6 is located below the first feeding unit 11. The second feeding unit 6 includes a casing 60, a second feeding cassette 61, a pickup roller 62, and a conveyance roller pair 63. The casing 60 accommodates the second feeding cassette 61, the pickup roller 62, and the conveyance roller pair 63. The first feeding cassette 111 accommodates a sheet P1. The second feeding cassette 61 accommodates a sheet P2. The sheet P1 is equivalent to an example of a "first recording medium" and the sheet P2 is equivalent to an example of a "second recording medium". In the following description, each of the sheet P1 and the sheet P2 may be referred to as a sheet P.

The sheet P1 picked up from the first feeding cassette 111 by the pickup roller 112 is conveyed by the conveyance roller pair 113 to the image forming device 14. The sheet P2 picked up from the second feeding cassette 61 by the pickup roller 62 is conveyed by the conveyance roller pair 63 to the image forming device 14 via the conveyance roller pair 113. The image forming device 14 forms an image on each of the sheet P1 and the sheet P2.

The sheet P with the image formed thereon is conveyed to the fixing device 15. The fixing device 15 applies heat and pressure to the sheet P, thus fixing the image formed on the sheet P to the sheet P. The sheet P with the image fixed thereto is ejected to the exit tray 17 by the ejection roller pair 16.

The operation display section 4 includes a touch panel 41. The touch panel 41 includes for example a liquid crystal display (LCD) and displays various images. The touch panel 41 further includes a touch sensor and receives the operation performed by the user.

The controller 5 includes a processor 51 and storage 52. The processor 51 includes a central processing unit (CPU), for example. The storage 52 includes memory such as a semiconductor memory, and may further include a hard disk drive (HDD). The storage 52 stores a control program therein.

As illustrated in FIG. 2, the first feeding cassette 111 and the second feeding cassette 61 can be pulled out to the front (negative side of the Y axis). In a state where the first feeding cassette 111 is pulled out to the front, the first feeding cassette 111 can be replenished with another sheet P1. In a state where the second feeding cassette 61 is pulled out to the front, the second feeding cassette 61 can be replenished with another sheet P2.

The casing 60 and the casing 10 are separate from each other. Side surfaces of the casing 60 are flush with corresponding side surfaces of the casing 10.

Figure 3:
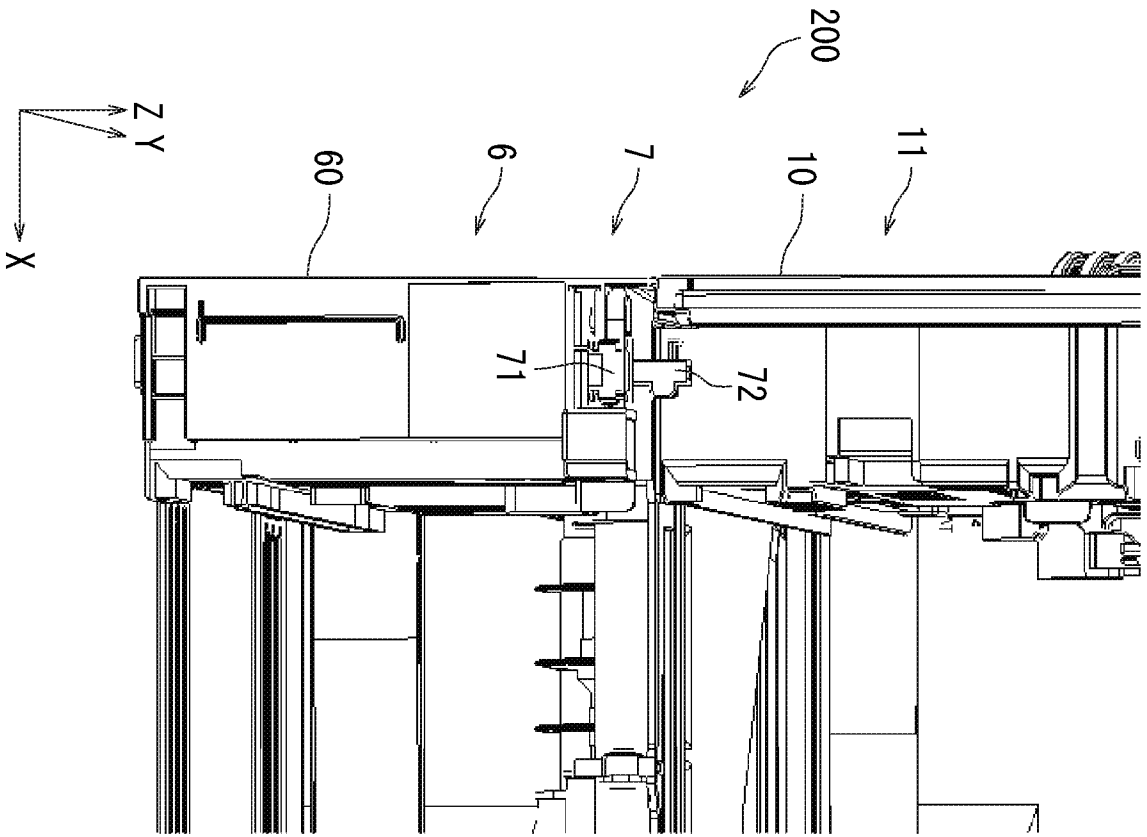
FIG. 3 is a perspective view illustrating a location of a fixing structure according to the embodiment of the present disclosure.

The following describes a location of a fixing structure 7 according to the embodiment of the present disclosure with reference to FIGS. 1 to 3. FIG. 3 is a perspective view illustrating the location of the fixing structure 7. As illustrated in FIG. 3, the feeding device 200 further includes the fixing structure 7. The fixing structure 7 is located between the casing 10 and the casing 60. Specifically, in an upper surface of the casing 60, the fixing structure 7 is located at an end on a negative side of the X axis (i.e., a side opposite to a side indicated by an arrow of the X axis) and a front end. The fixing structure 7 includes a base 71 and a fixing member 72. The base 71 and the fixing member 72 will be described later in detail with reference to FIGS. 4 to 10B.

Figure 4:
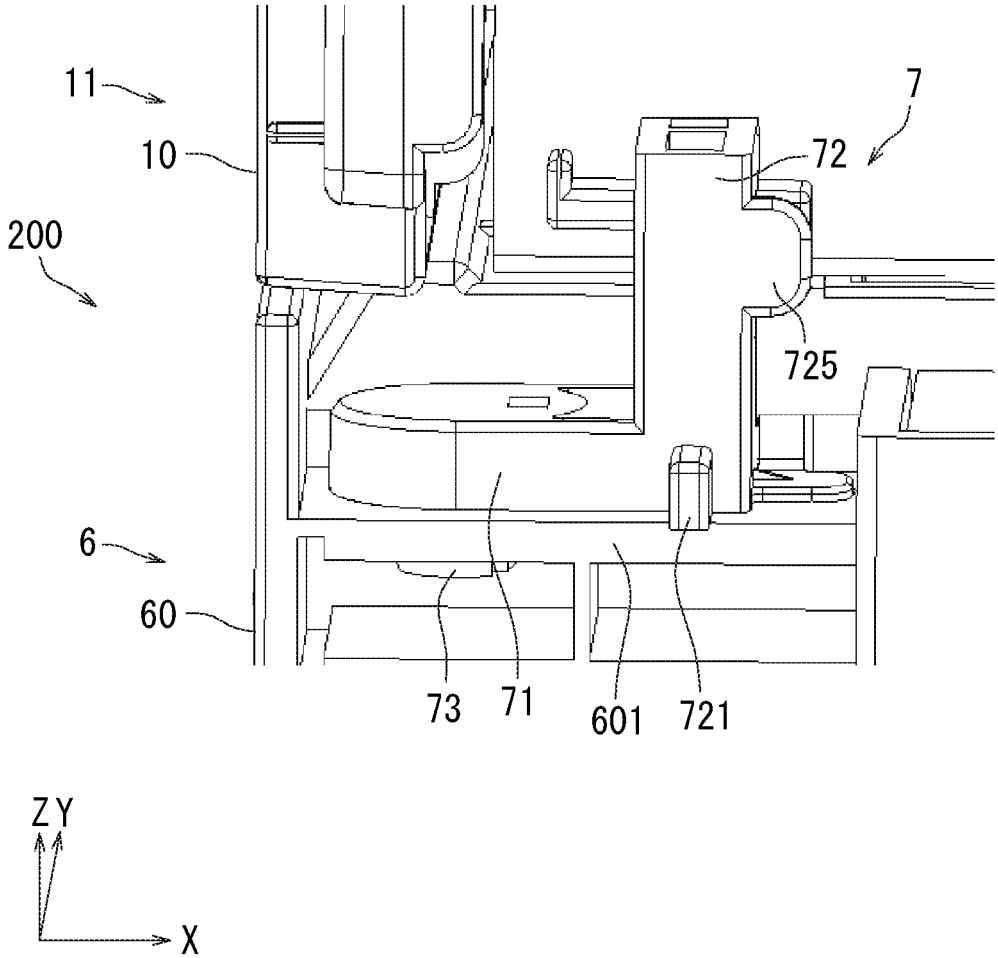
FIG. 4 is an enlarged perspective view illustrating a configuration of the fixing structure.

The following describes a configuration of the fixing structure 7 with reference to FIGS. 1 to 4. FIG. 4 is an enlarged perspective view illustrating the configuration of the fixing structure 7. That is, FIG. 4 is an enlarged perspective view of the fixing structure 7 illustrated in FIG. 3. As illustrated in FIG. 4, the fixing structure 7 further includes a cylindrical member 73. The casing 60 includes a first frame member 601.

The cylindrical member 73 has a cylindrical shape and is inserted through an "insertion hole" formed in the first frame member 601. The first frame member 601 is located at an upper end of the casing 60 and rotatably supports the cylindrical member 73. The fixing member 72 is connected with the cylindrical member 73 via the base 71. Specifically, the base 71, the fixing member 72, and the cylindrical member 73 are formed integrally with one another. That is, the first frame member 601 rotatably supports the fixing structure 7. The insertion hole will be described later in detail with reference to FIG. 9.

The fixing structure 7 takes a first posture or a second posture through rotation about the cylindrical member 73. When the fixing structure 7 is in the first posture, the fixing member 72 fixes the second feeding unit 6 to the first feeding unit 11. When the fixing structure 7 is in the second posture, the fixing structure 7 releases linkage between the second feeding unit 6 and the first feeding unit 11. The fixing structure 7 illustrated in FIG. 4 is in the first posture.

The fixing member 72 includes a first protruding member 721 and a handle member 725. The first protruding member 721 protrudes to the front.

The handle member 725 is held by the user when the user changes the posture of the fixing structure 7. Specifically, the user changes the posture of the fixing structure 7 by holding the handle member 725 and rotating the fixing structure 7 about the cylindrical member 73. For example, the user changes the posture of the fixing structure 7 from the first posture to the second posture. The user can release linkage between the second feeding unit 6 and the first feeding unit 11 by changing the posture of the fixing structure 7 from the first posture to the second posture. Alternatively, the user changes the posture of the fixing structure 7 from the second posture to the first posture. The user can fix the second feeding unit 6 to the first feeding unit 11 by changing the posture of the fixing structure 7 from the second posture to the first posture.

As described above with reference to FIGS. 1 to 4, the fixing structure 7 in the embodiment of the present disclosure fixes the second feeding unit 6 to the first feeding unit 11 when the fixing structure 7 is in the first posture. When the fixing structure 7 is in the second posture, the fixing structure 7 releases linkage between the second feeding unit 6 and the first feeding unit 11. Therefore, the second feeding unit 6 can be fixed to the first feeding unit 11 with a simple configuration.

The posture of the fixing structure 7 is changed between the first posture and the second posture through rotation of the fixing structure 7 about the cylindrical member 73. Therefore, the fixing structure 7 can have a simple configuration.

Figure 5:
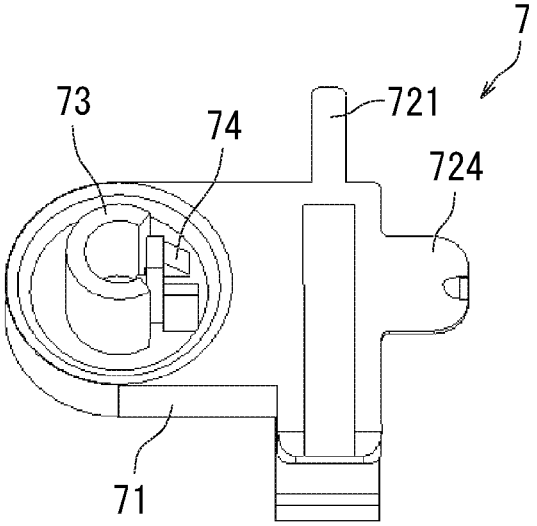
FIG. 5 is a perspective view of the fixing structure as seen from a side where a cylindrical member is provided.
Figure 6A:
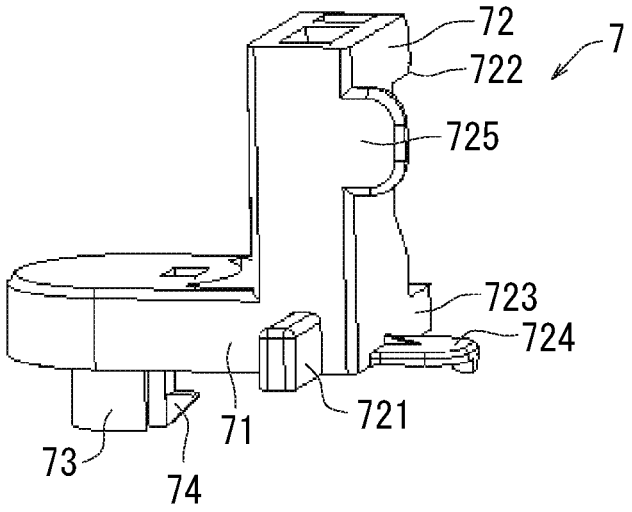
FIG. 6A is a perspective view of the fixing structure as seen from a side where a first protruding member is provided.
Figure 6B:
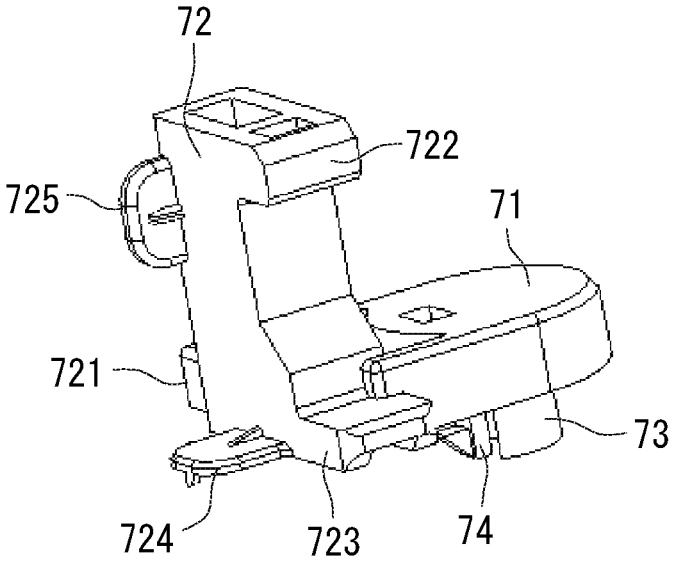
FIG. 6B is a perspective view of the fixing structure as seen from a side where a second protruding member is provided.

The following further describes the configuration of the fixing structure 7 with reference to FIGS. 4 to 6B. FIGS. 5, 6A, and 6B are perspective views illustrating the configuration of the fixing structure 7. FIG. 5 is a perspective view of the fixing structure 7 as seen from a side where the cylindrical member 73 is provided. As illustrated in FIG. 5, the fixing structure 7 further includes a first engagement member 74. Also, the fixing member 72 of the fixing structure 7 further includes a second protruding member 724. The second protruding member 724 will be described later in detail with reference to FIG. 7A.

The first engagement member 74 is inserted through the insertion hole formed in the first frame member 601. In a state where the cylindrical member 73 is inserted through the insertion hole, the first engagement member 74 engages with the first frame member 601. The state where the cylindrical member 73 is inserted through the insertion hole refers to a state where the fixing structure 7 is mounted to the second feeding unit 6. The insertion hole will be described later in detail with reference to FIG. 9.

The base 71 has the shape of a flat plate. The cylindrical member 73 and the first engagement member 74 project from a lower surface of the base 71. The lower surface of the base 71 is a surface of the base 71 facing toward a negative side of the Z axis (i.e., a side opposite to a side indicated by an arrow of the Z axis) in the state where the fixing structure 7 is mounted to the second feeding unit 6.

FIG. 6A is a perspective view of the fixing structure 7 as seen from a side where the first protruding member 721 is provided. As illustrated in FIG. 6A, the fixing member 72 of the fixing structure 7 further includes a first protrusion 722 and a second protrusion 723. The first protrusion 722 and the second protrusion 723 protrude in a direction opposite to the direction in which the first protruding member 721 protrudes. The first protrusion 722 is located at an upper end of the fixing member 72 and the second protrusion 723 is located at a lower end of the fixing member 72.

When the fixing structure 7 is in the first posture, the first protrusion 722 engages with a "second frame member" of the first feeding unit 11. The second frame member will be described later in detail with reference to FIG. 8.

When the fixing structure 7 is in the first posture, the second protrusion 723 engages with a "third frame member" of the second feeding unit 6. The third frame member will be described later in detail with reference to FIG. 8.

FIG. 6B is a perspective view of the fixing structure 7 as seen from a side where the second protruding member 724 is provided. As illustrated in FIG. 6B, the fixing member 72, the cylindrical member 73, and the second protruding member 724 are fixed to the base 71. The second protruding member 724 is a plate-like member protruding from the lower end of the fixing member 72 in a direction away from the base 71. The second protruding member 724 will be described later in detail with reference to FIG. 7A.

Figure 7A:
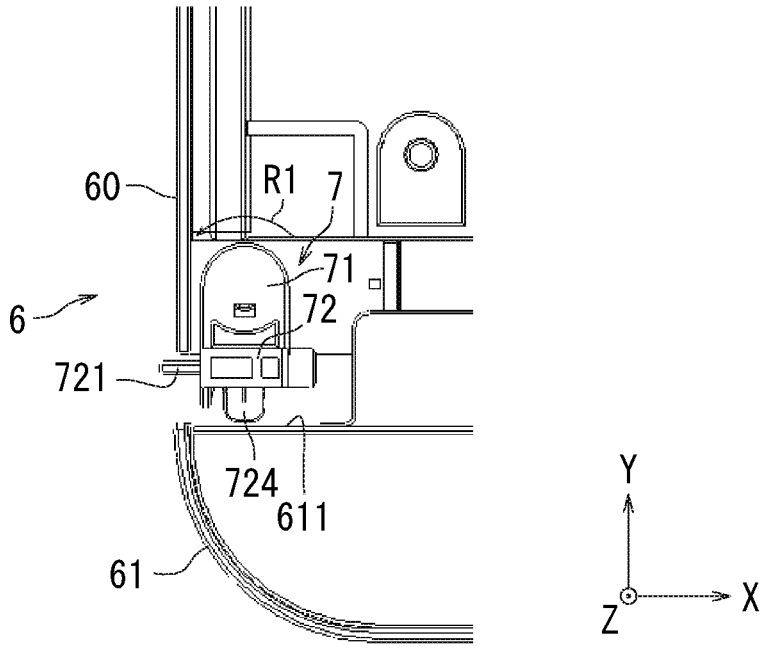
FIG. 7A is a top view of the fixing structure in a second posture.
Figure 7B:
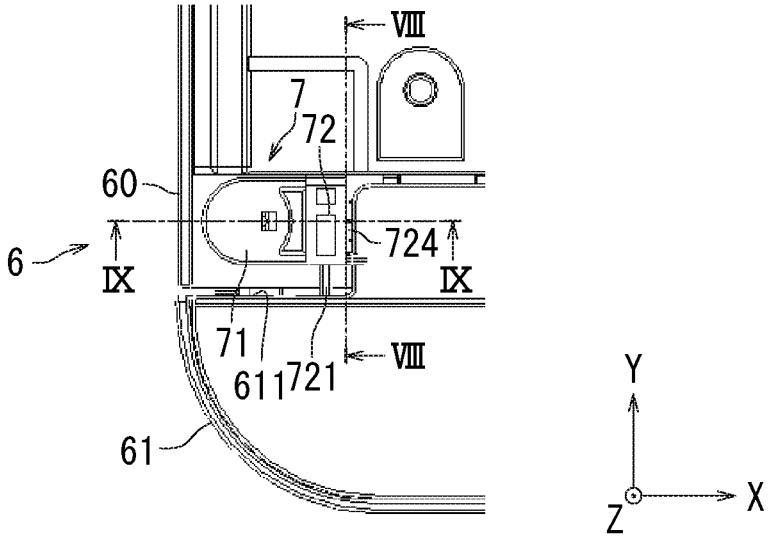
FIG. 7B is a top view of the fixing structure in a first posture.

The following describes the first posture and the second posture of the fixing structure 7 with reference to FIGS. 4 to 7B. FIG. 7A is a top view of the fixing structure 7 in the second posture. FIG. 7B is a top view of the fixing structure 7 in the first posture. FIGS. 7A and 7B illustrate the second feeding unit 6 removed from the image forming apparatus 100.

As illustrated in FIG. 7A, the second feeding cassette 61 includes a plate-like member 611. The plate-like member 611 included in the second feeding cassette 61 is in parallel to an X-Z plane. When the fixing structure 7 is in the second posture, the second protruding member 724 obstructs the second feeding cassette 61 from attaching to the second feeding unit 6. Specifically, when the second feeding cassette 61 is moved toward the positive side of the Y axis to be attached to the second feeding unit 6, the plate-like member 611 of the second feeding cassette 61 comes into contact with the second protruding member 724 of the fixing structure 7. As a result, the second feeding cassette 61 is obstructed from attaching to the second feeding unit 6.

When the fixing structure 7 is rotated by 90 degrees clockwise as indicated by an arrow R1 in FIG. 7A, the fixing structure 7 changes its posture from the second posture illustrated in FIG. 7A to the first posture illustrated in FIG. 7B.

When the fixing structure 7 is in the first posture as illustrated in FIG. 7B, the second protruding member 724 allows attachment of the second feeding cassette 61 to the second feeding unit 6. That is, the second protruding member 724 protrudes toward a positive side of the X axis (i.e., the side indicated by the arrow of the X axis). Accordingly, the plate-like member 611 does not come into contact with the second protruding member 724.

As described above with reference to FIGS. 4 to 7B, when the fixing structure 7 in the embodiment of the present disclosure is in the second posture, the second protruding member 724 obstructs the second feeding cassette 61 from attaching to the second feeding unit 6. Also, when the fixing structure 7 is in the second posture, the fixing structure 7 releases linkage between the second feeding unit 6 and the first feeding unit 11. Therefore, the second feeding cassette 61 can be prevented from being attached to the second feeding unit 6 in an unstable state where the second feeding unit 6 is not fixed to the first feeding unit 11.

Figure 8:
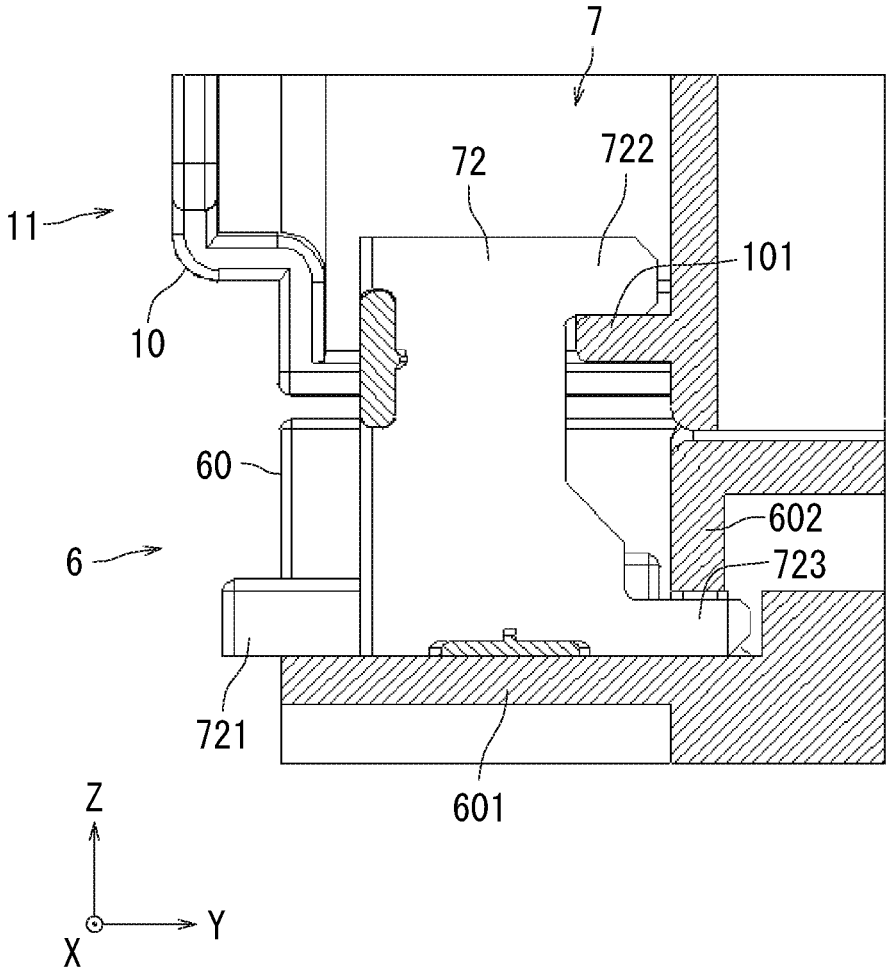
FIG. 8 is a cross-sectional view of the fixing structure in the first posture taken along a line VIII-VIII in FIG. 7B.

The following further describes the configuration of the fixing structure 7 with reference to FIGS. 4 to 8. FIG. 8 is a cross-sectional view of the fixing structure 7 in the first posture taken along a line VIII-VIII in FIG. 7B. As illustrated in FIG. 8, the casing 10 further includes a second frame member 101. The first protrusion 722 of the fixing member 72 of the fixing structure 7 engages with the second frame member 101 of the first feeding unit 11. Specifically, a lower surface of the first protrusion 722 is in contact with an upper surface of the second frame member 101.

The casing 60 further includes a third frame member 602. The second protrusion 723 of the fixing member 72 of the fixing structure 7 engages with the third frame member 602 of the second feeding unit 6. Specifically, an upper surface of the second protrusion 723 is in contact with a lower surface of the third frame member 602.

A bottom surface of the fixing member 72 is in contact with an upper surface of the first frame member 601. The bottom surface of the fixing member 72 is a surface of the fixing member 72 facing toward the negative side of the Z axis. That is, the second protrusion 723 is located between the upper surface of the first frame member 601 and the lower surface of the third frame member 602.

As described above with reference to FIGS. 4 to 8, when the fixing structure 7 in the embodiment of the present disclosure is in the first posture, the first protrusion 722 engages with the second frame member 101 of the casing 10 and the second protrusion 723 engages with the third frame member 602 of the casing 60. Therefore, the second feeding unit 6 can be fixed to the first feeding unit 11 with a simpler configuration. Also, the fixing member 72 fixes the third frame member 602 of the casing 60 to the second frame member 101 of the casing 10. Therefore, the second feeding unit 6 can be firmly fixed to the first feeding unit 11.

Figure 9:
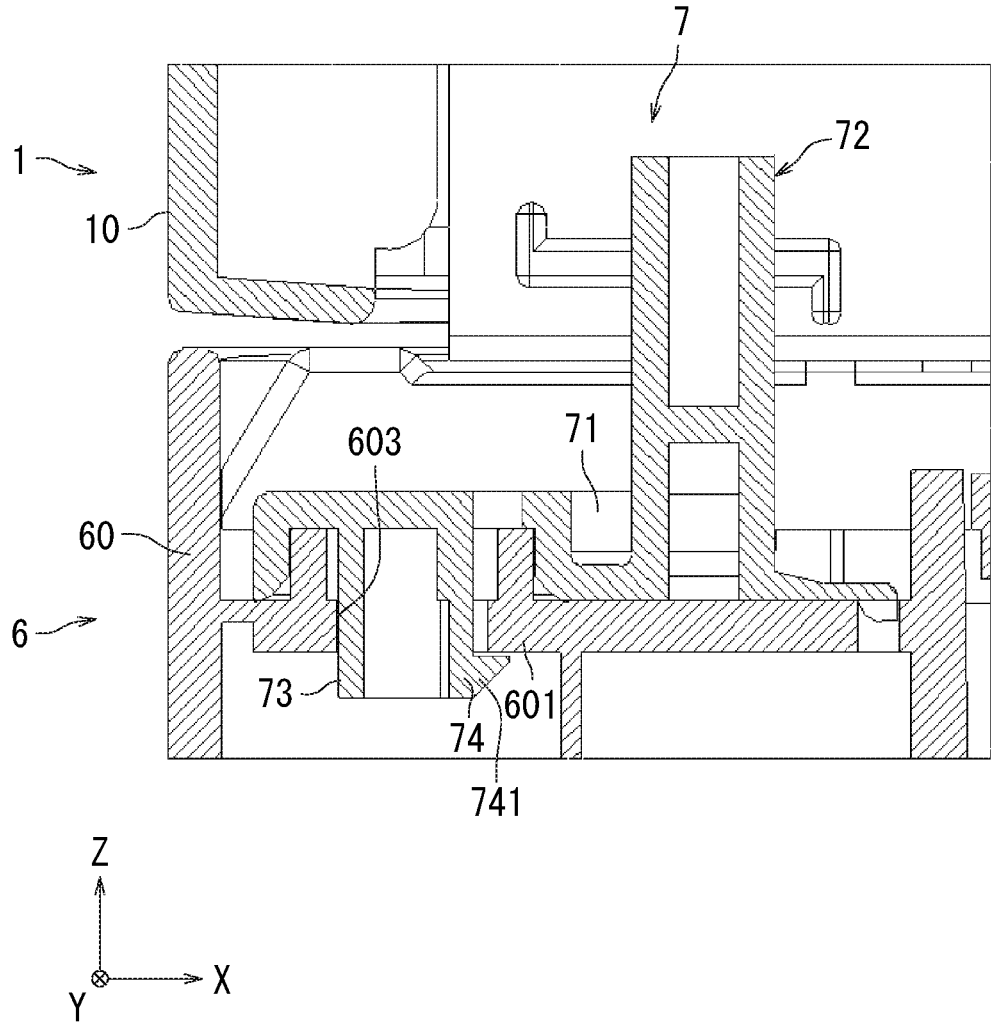
FIG. 9 is a cross-sectional view of the fixing structure in the first posture taken along a line IX-IX in FIG. 7B.

The following further describes the configuration of the fixing structure 7 with reference to FIGS. 4 to 9. FIG. 9 is a cross-sectional view of the fixing structure 7 in the first posture taken along a line IX-IX in FIG. 7B. As illustrated in FIG. 9, an insertion hole 603 is formed in the first frame member 601 of the casing 60. The insertion hole 603 has a cylindrical shape.

The cylindrical member 73 and the first engagement member 74 of the fixing structure 7 are inserted through the insertion hole 603. The first engagement member 74 engages with the first frame member 601. The first engagement member 74 includes an engagement portion 741 at a lower end thereof. The engagement portion 741 protrudes toward the positive side of the X axis. An upper surface of the engagement portion 741 of the first engagement member 74 is in contact with a lower surface of the first frame member 601.

As described above with reference to FIGS. 4 to 9, when the cylindrical member 73 and the first engagement member 74 are inserted through the insertion hole 603 in the embodiment of the present disclosure, the first engagement member 74 engages with the first frame member 601. Therefore, the user can rotate the fixing structure 7 in a state where the fixing structure 7 is engaged with the casing 60 of the second feeding unit 6. In this configuration, the user can change the posture of the fixing structure 7 more easily.

The following further describes the configuration of the fixing structure 7 with reference to FIGS. 4 to 10B. FIG. 10A is a perspective view illustrating a location of a detector 64. FIG. 10A illustrates the second feeding unit 6 in a state where the second feeding cassette 61 is pulled out from the casing 60. As illustrated in FIG. 10A, the second feeding unit 6 further includes the detector 64. Specifically, the detector 64 is located at an end of the second feeding cassette 61 on the negative side of the X axis and an end thereof on a positive side of the Z axis (i.e., the side indicated by the arrow of the Z axis). The detector 64 detects the fixing structure 7 taking the first posture.

The detector 64 includes a detection switch SW and a rod-like member 641. The detection switch SW is a press button switch, for example. The detection switch SW detects the fixing structure 7 taking the first posture when the detection switch SW is pressed by the rod-like member 641.

The rod-like member 641 is disposed in the second feeding cassette 61 such that a longitudinal direction of the rod-like member 641 substantially coincides with the Y axis direction. The plate-like member 611 of the second feeding cassette 61 has an opening 611A. The opening 611A has a rectangular shape. The rod-like member 641 is inserted through the opening 611A and is projectable and retractable relative to the plate-like member 611. The rod-like member 641 is urged by an unillustrated urging member so as to protrude toward the positive side of the Y axis relative to the plate-like member 611.

Figure 10A:
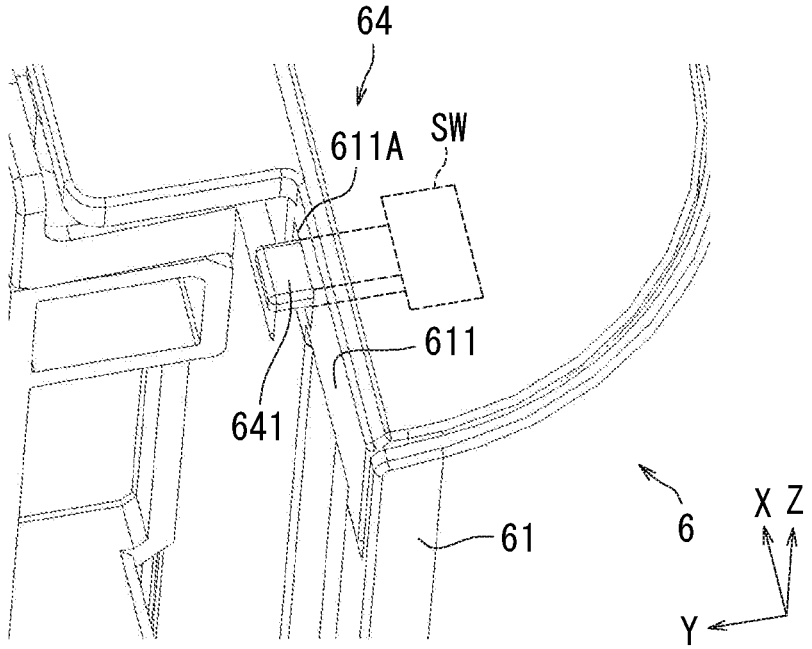
FIG. 10A is a perspective view illustrating a location of a detector.
Figure 10B:
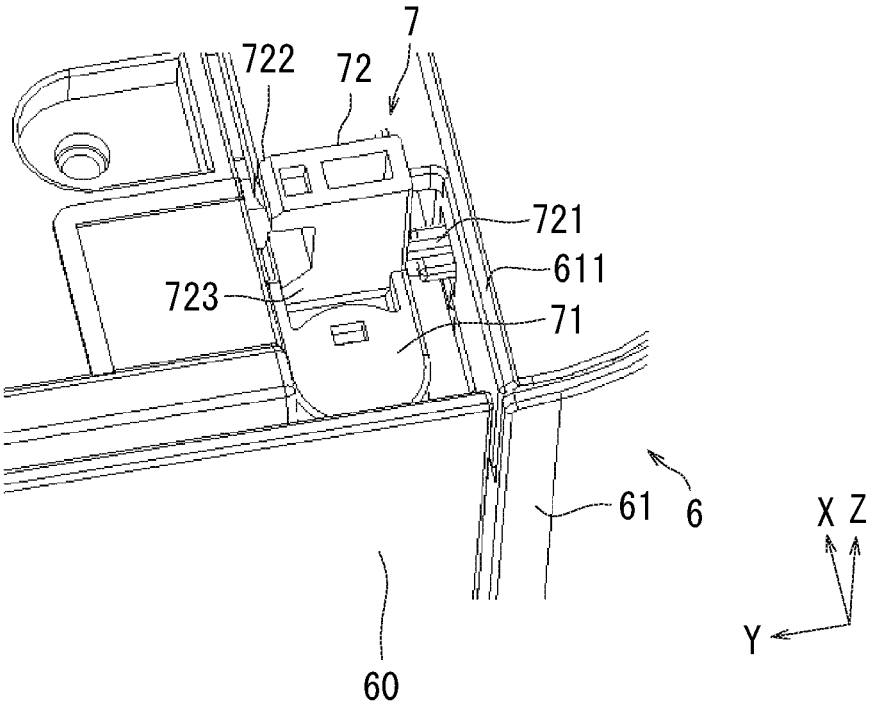
FIG. 10B is a perspective view illustrating the fixing structure in the first posture.

FIG. 10B is a perspective view illustrating the fixing structure 7 in the first posture. As illustrated in FIG. 10B, when the fixing structure 7 is in the first posture, the rod-like member 641 is caused to retract into the second feeding cassette 61 by the first protruding member 721. Specifically, an end of the first protruding member 721 on the negative side of the Y axis comes into contact with an end of the rod-like member 641 on the positive side of the Y axis to press and move the rod-like member 641 toward the negative side of the Y axis. As a result, the rod-like member 641 retracts into the second feeding cassette 61. Note that when the fixing structure 7 is in the second posture, the first protruding member 721 is spaced from the rod-like member 641 (see FIG. 7A).

As described above with reference to FIGS. 4 to 10B, the detector 64 in the embodiment of the present disclosure detects the fixing structure 7 taking the first posture. Therefore, whether or not the second feeding unit 6 is fixed to the first feeding unit 11 can be detected. As a result, the user can be notified of whether or not the second feeding unit 6 is fixed to the first feeding unit 11.

Also, the detector 64 detects the fixing structure 7 taking the first posture when the rod-like member 641 is retracted. Therefore, the fixing structure 7 taking the first posture can be detected with a simple configuration.

Although the detector 64 is provided on the second feeding cassette 61 in the embodiment of the present disclosure, the present disclosure is not limited to this configuration. It is only required that the detector 64 be included in the second feeding unit 6. For example, the detector 64 may be provided inside the casing 60 of the second feeding unit 6.

Although the detector 64 includes the detection switch SW and the rod-like member 641 in the embodiment of the present disclosure, the present disclosure is not limited to this configuration. It is only required that the detector 64 detect the fixing structure 7 taking the first posture. For example, the detector 64 may include a proximity sensor and detect the first protruding member 721 located within a specific distance from the detector 64. The specific distance is for example 5 mm.

Figure 11:
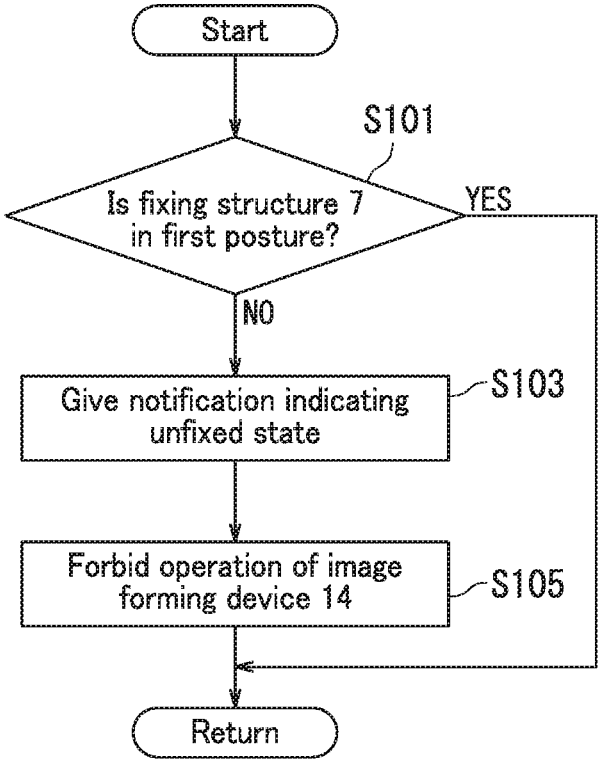
FIG. 11 is a flowchart illustrating processing performed by a controller.

The following describes processing performed by the controller 5 with reference to FIGS. 1 and 4 to 11. FIG. 11 is a flowchart illustrating the processing performed by the controller 5. Specifically, the processor 51 of the controller 5 performs the processing illustrated in FIG. 11 through execution of the control program.

As illustrated in FIG. 11, the controller 5 determines whether or not the fixing structure 7 is in the first posture at Step S101. Specifically, the controller 5 determines whether or not the fixing structure 7 is in the first posture on the basis of a result of detection by the detector 64.

When the controller 5 determines that the fixing structure 7 is in the first posture (YES at Step S101), the routine returns to the start. When the controller 5 determines that the fixing structure 7 is not in the first posture (NO at Step S101), the routine proceeds to Step S103.

At Step S103, the controller 5 causes the touch panel 41 to give a notification indicating that the second feeding unit 6 is not fixed to the first feeding unit 11.

At Step S105, the controller 5 forbids operation of the image forming device 14, and the routine then returns to the start.

As described above with reference to FIGS. 1 and 4 to 11, whether or not the fixing structure 7 is in the first posture is determined on the basis of the result of detection by the detector 64. When the controller 5 determines that the fixing structure 7 is not in the first posture, the controller 5 causes the touch panel 41 to give the notification indicating that the second feeding unit 6 is not fixed to the first feeding unit 11. Therefore, the user can know that the second feeding unit 6 is not fixed to the first feeding unit 11. This results in improvement of convenience for the user.

Also, the controller 5 forbids operation of the image forming device 14 when the fixing structure 7 is not in the first posture. Therefore, the image forming device 14 can be prevented from being operated in an unstable state where the second feeding unit 6 is not fixed to the first feeding unit 11.

Although the controller 5 causes the touch panel 41 to give the notification indicating that the second feeding unit 6 is not fixed to the first feeding unit 11 in the embodiment of the present disclosure, the present disclosure is not limited to this configuration. It is only required that the controller 5 give a notification of the result of detection by the detector 64. For example, the image forming apparatus 100 may include a speaker, and the controller 5 may output voice sound that gives the notification of the result of detection by the detector 64 through the speaker.

Figure 12:
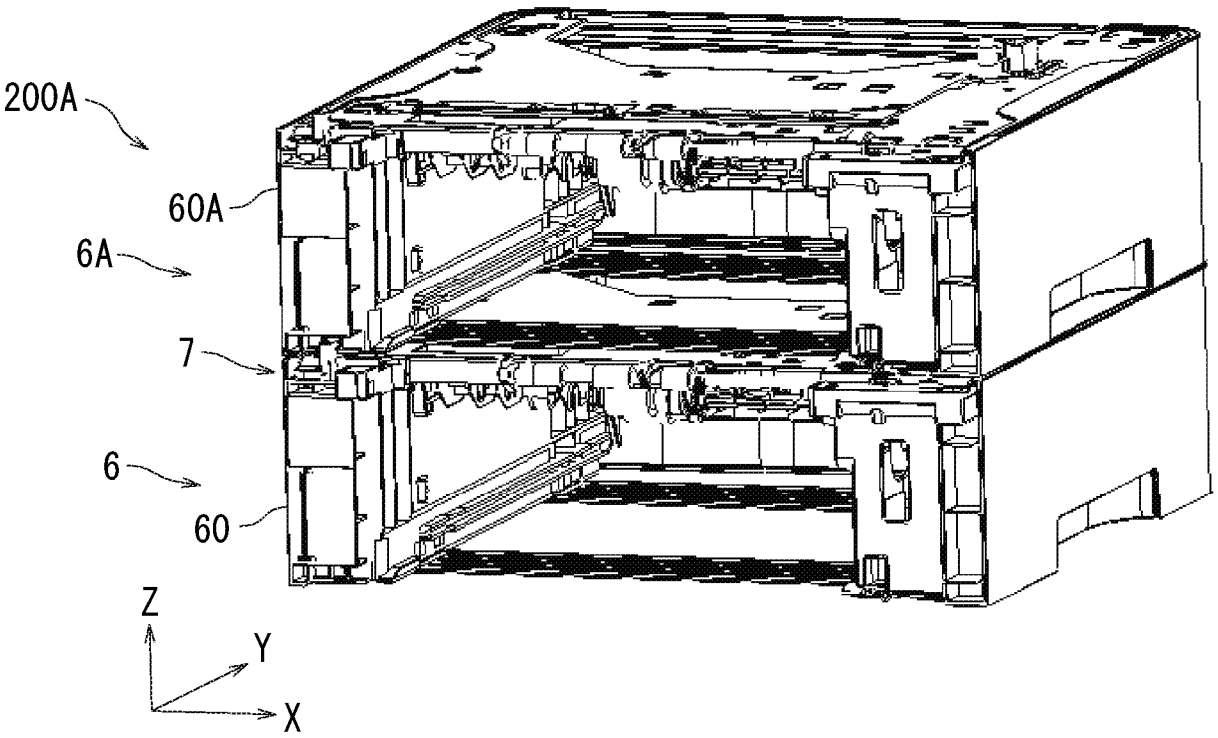
FIG. 12 is a perspective view illustrating a variation of a feeding device.

The following describes a variation of the feeding device with reference to FIGS. 1 to 3, 8, and 12. FIG. 12 is a perspective view illustrating the variation of the feeding device. A feeding device 200A illustrated in FIG. 12 differs from the feeding device 200 illustrated in FIGS. 1 to 3 in that the feeding device 200A includes a first feeding unit 6A. That is, the feeding device 200 illustrated in FIGS. 1 to 3 includes: the first feeding unit 11 located within the casing 10 of the image forming apparatus 100; the second feeding unit 6; and the fixing structure 7, whereas the feeding device 200A illustrated in FIG. 12 includes the first feeding unit 6A, the second feeding unit 6, and the fixing structure 7.

In other words, the fixing structure 7 illustrated in FIG. 3 fixes the second feeding unit 6 to the first feeding unit 11 located within the casing 10 of the image forming apparatus 100, whereas the fixing structure 7 illustrated in FIG. 12 fixes the second feeding unit 6 to the first feeding unit 6A.

The first feeding unit 6A has the same configuration as that of the second feeding unit 6. The first feeding unit 6A includes a casing 60A.

That is, the casing 60A includes a second frame member (not illustrated) located at a lower end of the first feeding unit 6A, and the casing 60 includes the third frame member 602 (see FIG. 8) located at an upper end of the second feeding unit 6. The fixing structure 7 fixes the third frame member 602 to the second frame member.

As described above with reference to FIGS. 1 to 3, 8, and 12, the fixing structure 7 fixes the second feeding unit 6 to the first feeding unit 6A. Therefore, the second feeding unit 6 can be fixed to the first feeding unit 6A with a simple configuration.

The embodiment of the present disclosure has been described with reference to the drawings. However, the present disclosure is not limited to the above embodiment and can be practiced in various forms (for example, as described below in (1) and (2)) within a scope not departing from the gist of the present disclosure. The drawings schematically illustrate elements of configuration to facilitate understanding. Properties such as the thickness and the length, and the numbers of the elements of configuration illustrated in the drawings may differ from actual ones thereof to facilitate preparation of the drawings. Also, the shape, dimensions, and the like of elements of configuration described in the above embodiment are merely examples and should not be taken as specific limitations. Various alterations can be made within a scope not substantially departing from the configuration of the present disclosure.

(1) As described with reference to FIG. 1, the image forming apparatus 100 is a multifunction peripheral, which however should not be taken to limit the present disclosure. It is only required that the image forming apparatus 100 include the image forming device 14. The image forming apparatus may be a color printer, for example. Alternatively, the image forming apparatus may be a monochrome copier, for example.

(2) As described with reference to FIGS. 1 to 4, the feeding device 200 includes a single fixing structure 7, which however should not be taken to limit the present disclosure. It is only required that the feeding device 200 include the fixing structure 7. For example, the feeding device 200 may include a plurality of the fixing structures 7. Specifically, in the second feeding unit 6, the fixing structures 7 may be provided at respective ends on the positive side and the negative side of the X axis. In this configuration, the second feeding unit 6 can be more firmly fixed to the first feeding unit 11.

What is claimed is:

1. A feeding device comprising:

a first feeding unit configured to feed a first recording medium;

a second feeding unit located below the first feeding unit and configured to feed a second recording medium differing from the first recording medium; and a fixing structure configured to take a first posture or a second posture differing from the first posture, the fixing structure fixing the second feeding unit to the first feeding unit when the fixing structure is in the first posture, wherein the second feeding unit includes an insertion hole at an upper end thereof and a first frame member at the upper end thereof, the fixing structure includes a cylindrical member inserted through the insertion hole and a first engagement member inserted through the insertion hole, in a state where the cylindrical member and the first engagement member are inserted through the insertion hole, the first engagement member engages with the first frame member, through rotation of the fixing structure about the cylindrical member, a posture of the fixing structure is changed between the first posture and the second posture, the fixing structure fixes the second feeding unit to the first feeding unit by fixing the first frame member of the second feeding unit to a second frame member of the first feeding unit, and when the fixing structure is in the second posture, the fixing structure releases linkage between the second feeding unit and the first feeding unit.

2. The feeding device according to claim 1, wherein the fixing structure further includes a fixing member that fixes the second feeding unit to the first feeding unit, the fixing member is connected with the cylindrical member, the fixing member includes a first protrusion and a second protrusion differing from the first protrusion, the frame member of the first feeding unit is a second frame member located at a lower end of the first feeding unit, the frame member of the second feeding unit is a third frame member located at the upper end of the second feeding unit, the third frame member differing from the first frame member, when the fixing structure is in the first posture, the first protrusion engages with the second frame member and the second protrusion engages with the third frame member, and when the fixing structure is in the second posture, the first protrusion is disengaged from the second frame member and the second protrusion is disengaged from the third frame member.

3. The feeding device according to claim 1, wherein the second feeding unit further includes a detector that detects the fixing structure taking the first posture.

4. A feeding device comprising:

a first feeding unit configured to feed a first recording medium;

a second feeding unit located below the first feeding unit and configured to feed a second recording medium differing from the first recording medium; and a fixing structure configured to take a first posture or a second posture differing from the first posture, the fixing structure fixing the second feeding unit to the first feeding unit when the fixing structure is in the first posture, wherein the fixing structure fixes the second feeding unit to the first feeding unit by fixing a frame member of the second feeding unit to a frame member of the first feeding unit, when the fixing structure is in the second posture, the fixing structure releases linkage between the second feeding unit and the first feeding unit, the second feeding unit further includes a feeding cassette in which the second recording medium is stacked, the feeding cassette is attachable to and detachable from the second feeding unit, the fixing structure further includes a protruding member, when the fixing structure is in the first posture, the protruding member allows attachment of the feeding cassette to the second feeding unit, and when the fixing structure is in the second posture, the second protruding member obstructs the feeding cassette from attaching to the second feeding unit.

5. An image forming apparatus comprising:

an image forming device configured to form an image on a recording medium, the recording medium being either a first recording medium or a second recording medium differing from the first recording medium;

a first feeding unit configured to feed the first recording medium to the image forming device;

a second feeding unit located below the first feeding unit and configured to feed the second recording medium to the image forming device; and a fixing structure configured to take a first posture or a second posture differing from the first posture, the fixing structure fixing the second feeding unit to the first feeding unit when the fixing structure is in the first posture, wherein the fixing structure fixes the second feeding unit to the first feeding unit by fixing a frame member of the second feeding unit to a frame member of the first feeding unit, and when the fixing structure is in the second posture, the fixing structure releases linkage between the second feeding unit and the first feeding unit, the image forming apparatus further comprises:

a detector configured to detect the fixing structure taking the first posture; and a controller configured to control operation of the image forming apparatus, and the controller gives a notification of a result of detection by the detector.

6. The image forming apparatus according to claim 5, wherein when the detector does not detect the fixing structure taking the first posture, the controller forbids operation of the image forming device.

* * * * *